US006481414B2

(12) United States Patent
Kalweit et al.

(10) Patent No.: US 6,481,414 B2
(45) Date of Patent: Nov. 19, 2002

(54) METHOD OF CONTROLLING AN INTERNAL COMBUSTION ENGINE

(75) Inventors: Dieter Kalweit, Schorndorf (DE); Sven Merkle, Stuttgart (DE); Tobias Roulet, Leonberg (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/955,214

(22) Filed: Sep. 17, 2001

(65) Prior Publication Data

US 2002/0059917 A1 May 23, 2002

(30) Foreign Application Priority Data

Sep. 18, 2000 (DE) ..... 100 46 449

(51) Int. Cl.[7] ..... F02D 7/00
(52) U.S. Cl. ..... 123/399
(58) Field of Search ..... 123/399, 319, 123/349, 395, 403

(56) References Cited

U.S. PATENT DOCUMENTS 5,611,309 A * 3/1997 Kumagai et al. ..... 123/399
5,706,782 A * 1/1998 Kurihara ..... 123/399
5,775,295 A * 7/1998 Aubourg et al. ..... 123/399
6,305,351 B1 * 10/2001 Neumann et al. ..... 123/352

* cited by examiner

*Primary Examiner*—Bibhu Mohanty
(74) *Attorney, Agent, or Firm*—Klaus J. Bach

(57) ABSTRACT

In a method for setting an intake manifold pressure or a mass volumetric efficiency of an internal combustion engine, a change in the setting of the engine throttle valve when needed during operation of the engine is increased beyond the desired setting by such an amount and for such a period of time that the change in the setting of the throttle valve corresponds at least approximately to the air mass flow rate which is required in order to set the internal combustion engine to the new load state.

3 Claims, 2 Drawing Sheets

METHOD OF CONTROLLING AN INTERNAL COMBUSTION ENGINE

BACKGROUND OF THE INVENTION

The invention relates to a method of controlling an internal combustion engine by setting an intake manifold pressure or a mass volumetric efficiency of an internal combustion engine.

A method in which, with a change of the load state of the internal combustion engine, the throttle valve setting of the new load state is determined, and the throttle valve is then adjusted to the new throttle valve setting. The intake manifold pressure is then adjusted, with a certain time profile, to the value which corresponds to the new load state.

It is the object of the present invention to improve the setting of the intake manifold pressure or of the mass volumetric efficiency.

SUMMARY OF THE INVENTION

In a method for setting an intake manifold pressure or a mass volumetric efficiency of an internal combustion engine, when the intake manifold pressure needs to be changed during operation of the internal combustion engine, the change in the setting of the throttle valve is exceeded by such an amount and for such a period of time that the change in the setting of the throttle valve corresponds at least approximately to the air mass flow rate which is required in order to set the internal combustion engine to the new load state.

It is advantageous herein that the setting of the new load state takes place significantly more quickly because the increased activation of the throttle valve shortens the transient response time to the new load state. This takes place by virtue of the fact that, when there is a transition to a state with a relatively large load, the throttle valve is opened further in the period of transition than corresponds to the new load state.

This can take place, for example, by a model, which provides for a relation between the intake manifold pressure, the temperature and the volume on one hand and the masses of the gases on the other, using the ideal gas equation for estimating what change in the mass over time is necessary for a specific change in the intake manifold pressure over time. In accordance with this change in the mass over time, it is possible then to calculate what adjustment of the throttle valve is necessary.

The dynamics in setting the changing load states of the internal combustion engine are therefore advantageously improved by the use of the present invention.

The method can, for example, be used advantageously for an internal combustion engine with cylinders which can selectively be shut off. In this case a gas change is prevented by not operating the inlet and outlet valves. When the cylinders which can be shut off are activated again, the new load state can be rapidly adjusted.

When it is necessary to change the intake manifold pressure during operation of the internal combustion engine, a time profile of the throttle valve setting is determined in such a way that the new intake manifold pressure is set within an optimum time on the basis of the time profile of the mass flow rate as controlled by the throttle valve setting.

The time profile of the throttle valve setting can advantageously be determined in such a way that the mass flow rate which results from the extreme settings of the throttle valve (opened or closed to a maximum extent) is determined on the basis thereof. In accordance with the explanations presented above, it is also possible to determine from the requirements of the air mass flow rate which is required, for example, in the case of a relatively large load, and the resulting mass flow rate, the time period for which the throttle valve must be opened to a maximum extent in order to bring about the change in the load state of the internal combustion engine in a way which is optimal with respect to time. The throttle valve is then actuated in such a way that, at the start of the transition to a state with a relative large load, the throttle valve is opened to a maximum extent for the specific time period. Subsequently, the throttle valve is set to the value which corresponds to the required mass flow rate for the new load state during steady state operation. The actuation of the throttle valve then takes place by means of a jump function. In analogous fashion, if a smaller internal combustion engine load is to be set the time period for which the throttle valve has to be closed may be determined in order achieve the state of a lower internal combustion engine load within an optimal time period. An air mass must then be retained. The time period can be determined by determining the mass flow rate at the throttle valve setting which corresponds to the new load state. On the basis of the air mass retained and the mass flow determined the time period is obtained during which the throttle valve has to be closed.

Particularly rapid load state setting changes can be brought about with this method.

A time profile of the anticipated value of the mass flow rate which is set or of the intake manifold pressure which is set is determined on the basis of the time profile of the throttle valve setting, in which case the actual value of the mass flow rate or of the intake manifold pressure continues to be determined and, when there is a deviation of the actual value from the respective anticipated value, the throttle valve is operated with a view to eliminating the deviation.

As a result, it is possible to sense advantageously by means of a control operation, whether the desired time profile of the intake manifold pressure or of the mass volumetric efficiency is set on the basis of the actuation of the throttle valve. If this is not the case, the control value (setting of the throttle valve) can be appropriately changed. If the throttle valve is already actuated to a maximum degree i.e. either entirely opened or entirely closed, it is possible, for example, to correct appropriately the time period during which this maximum actuation is to occur at the throttle valve. This further improves the setting accuracy when the load state changes in a dynamic and a rapid fashion. The corresponding values can either be measured directly or derived on the basis of a model by reference to other measurement values.

An embodiment of the invention will be described below in greater detail on the basis of the accompanying drawings.

DESCRIPTION OF A PREFERRED EMBODIMENT

Figure 1:
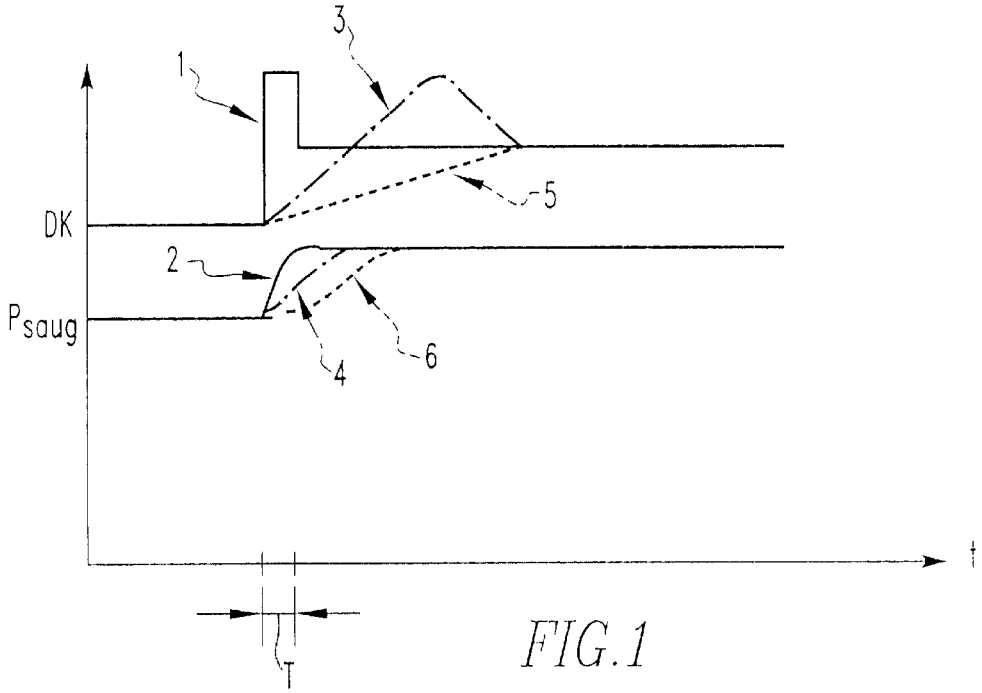
FIG. 1 is a view of the time profile of the setting of the throttle valve and the resulting intake manifold pressure.

FIG. 1 shows, based on time, the setting of the throttle valve and of the intake manifold pressure controlled thereby.

Various time based throttle valve settings DK are represented (1, 3 and 5). The time-dependent intake manifold pressure $p_{saug}$, (2, 4 and 6) correspond to these settings.

It is apparent that with a time profile of the throttle valve setting corresponding to curve 1, the static final state of the intake manifold pressure is reached most quickly (curve 2). The time period T during which the throttle valve is opened to a maximum degree is determined as explained in the introduction to the description.

It is also apparent that the final state of the intake manifold pressure is reached correspondingly more slowly (curves 4 and 6) when the throttle valve is adjusted in accordance with curves 3 and 5.

Figure 2:
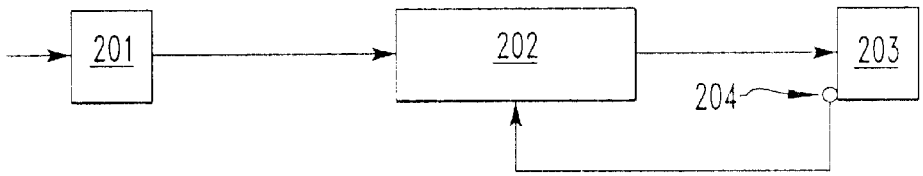
FIG. 2 is a basic view of functional blocks for explanation of the method.

In the functional blocks shown in FIG. 2, a changed setting of the throttle valve in the steady-state condition is derived in the block 201 on the basis of the request for a change of a load state of the internal combustion engine 203 in order to be able to set the load state of the internal combustion engine.

In the block 202, an actuation process of the throttle valve is determined in order to be able to set the change in the load state as rapidly as possible. A corresponding signal is supplied to the throttle valve from the unit 202.

In the exemplary embodiment illustrated, a sensor 204 for sensing the intake manifold pressure is located on the internal combustion engine 203.

The sensor 204 provides a signal which is in turn fed to the unit 202 in which, in addition to the time profile of the actuation of the throttle valve, a time profile of anticipated values of the intake manifold pressure which is set is also determined. The intake manifold pressure which is measured with the sensor 204 can be compared with the corresponding anticipated value, and when there is a deviation, a corresponding change in the actuation of the throttle valve may be initiated. For example, the time period T of maximum actuation of the throttle valve can be lengthened or shortened.

Figure 3:
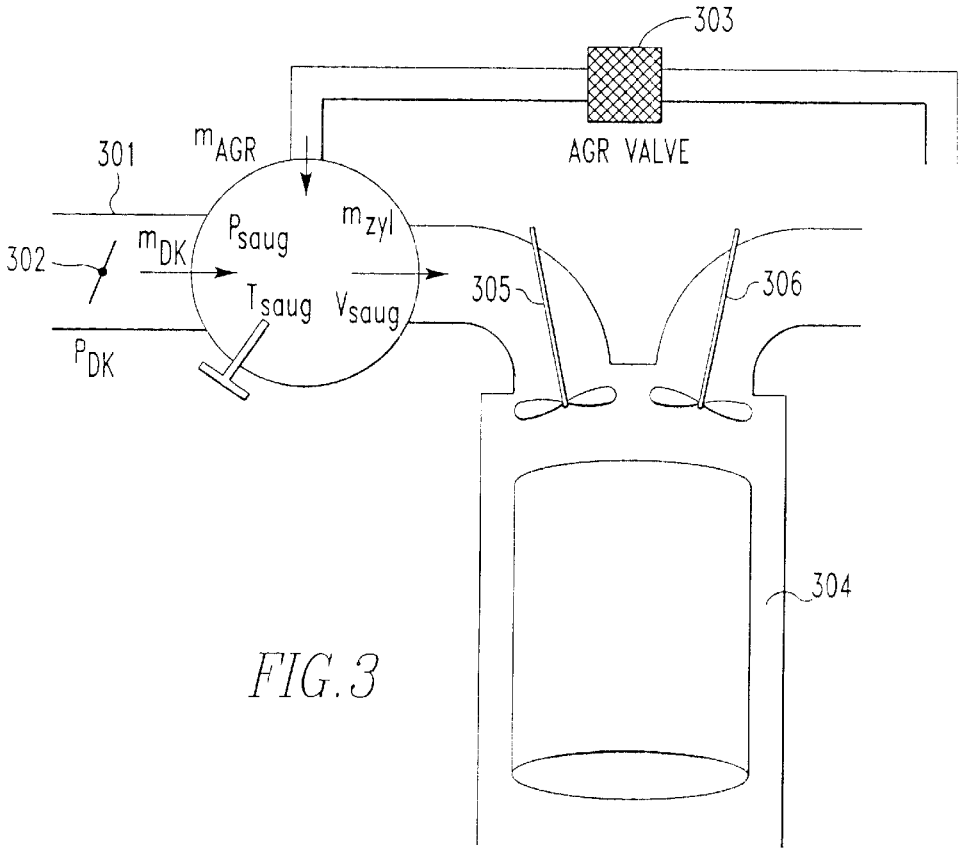
FIG. 3 is a view of a model for calculating the necessary change in the throttle valve setting in order to bring about a specific change in the intake manifold pressure.

FIG. 3 shows a model which will be explained below. An intake manifold 301 with a throttle valve 302 is shown. Furthermore, an exhaust gas recirculation duct (AGR) is shown in which a valve 303 is provided. Furthermore, a cylinder 304 with an inlet valve 305 and an outlet valve 306 is shown.

The intake manifold pressure $p_{saug}$ can be represented by means of the ideal gas equation as a sum of the individual components of the gases which are, based on various effects on the intake manifold 301 with the intake manifold volume $V_{saug}$:

$$p_{saug} = \frac{R_g * T_{saug}}{V_{saug}} * \sum_{k}^{flows} m_k$$

With $m_{DK}$ as the proportion of the mass flow in the intake manifold 301 resulting from the throttle valve setting, $m_{AGR}$ as the proportion of the mass flow in the intake manifold as a result of the exhaust gas recirculation line, $m_{TE}$ as the proportion of the mass flow to be fed back to the tank vent and the proportion of the mass flow in the cylinder $m_{zyl}$ the following is obtained:

$$dm_{DK}/dt = \frac{dp_{saug}/dt * V_{saug}}{R_g * T_{saug}} - dm_{AGR}/dt - dm_{TE}/dt - dm_{zyl}/dt$$

In summary, it is possible to infer that a rapid change in the intake manifold pressure results in a rapid change in the air mass flow rate by means of the throttle valve. The system setting times of the throttle valve actuator, the intake manifold volume $V_{saug}$, the engine speed and the cylinder volume with their influence on the variable $m_{zyl}$ determine possible intake manifold pressure gradients.

What is claimed is:

1. A method of setting an intake manifold pressure or a mass volumetric efficiency of an internal combustion engine for a new engine load condition, said method comprising the steps of: changing, upon occurance of a need, the intake manifold pressure during operation of the internal combustion engine, increasing in excess the change in the setting of the throttle valve by such an absolute value and for such a period of time that the excess in the setting of the throttle valve corresponds at least approximately to the air mass flow rate which is required in order to set the internal combustion engine to the new load state.

2. A method according to claim 1, wherein, for changing the intake manifold pressure during operation of the internal combustion engine, a time profile of the throttle valve setting is determined in such a way that a new intake manifold pressure is set so as to provide an optimum with respect to time on the basis of the time profile of the mass flow rate which is set as a result of the throttle valve setting.

3. A method according to claim 1, wherein a time profile of the anticipated value of one of the mass flow rate which is set and of the intake manifold pressure which is set is determined on the basis of the time profile of the throttle valve setting, and wherein the actual value of the mass flow rate or respectively, of the intake manifold pressure is determined, and, when there is a deviation of the actual value from the associated anticipated value, the throttle valve is actuated so as to eliminate the deviation.

* * * * *